US011834766B2

(12) United States Patent
Morimoto et al.

(10) Patent No.: US 11,834,766 B2
(45) Date of Patent: Dec. 5, 2023

(54) SEWING DEVICE AND LOOPER POSITIONING METHOD

(71) Applicant: HONDA MOTOR CO., LTD., Tokyo (JP)

(72) Inventors: Taisuke Morimoto, Tokyo (JP); Yosuke Ikadai, Tokyo (JP); Kazuma Nakayama, Tokyo (JP); Tohru Takamura, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/676,836

(22) Filed: Feb. 22, 2022

(65) Prior Publication Data

US 2022/0307178 A1 Sep. 29, 2022

(30) Foreign Application Priority Data

Mar. 26, 2021 (CN) ..... 202110323474.X

(51) Int. Cl.
*D05B 1/06* (2006.01)
*D05B 57/04* (2006.01)

(52) U.S. Cl.
CPC ..... *D05B 1/06* (2013.01); *D05B 57/04* (2013.01)

(58) Field of Classification Search
CPC ..... D05B 57/04; D05B 1/06; D05B 57/06; D05B 57/08; D05B 57/30; D05B 57/32; D05B 57/34; D05B 57/38; D05B 57/36
See application file for complete search history.

(56) References Cited

U.S. PATENT DOCUMENTS 3,871,311 A * 3/1975 Ciecior ..... D05B 57/02 112/200
3,941,068 A * 3/1976 Washburn ..... D05B 1/20 112/162
4,942,834 A * 7/1990 Kitai ..... D05B 57/06 112/159

(Continued)

FOREIGN PATENT DOCUMENTS

CN 1148643 A 4/1997
CN 101158091 A 4/2008

(Continued)

OTHER PUBLICATIONS

Office Action issued in the CN Patent Application No. 202110323474.X, dated Aug. 11, 2023.

*Primary Examiner* — Danny Worrell
(74) *Attorney, Agent, or Firm* — CKC & Partners Co., LLC

(57) ABSTRACT

There is provided a sewing device comprising a needle and a looper, the sewing device including a rotation shaft that rotates the looper, and a set bolt that has a conical distal end and positions the looper in an axial direction relative to the rotation shaft from a radial direction of the rotation shaft, in which the looper includes a through screw hole into which the set bolt is screwed, the rotation shaft includes a groove recessed from a peripheral surface of the rotation shaft, and the groove includes an inclined surface that the distal end of the set bolt contacts. In one aspect, in the sewing device, a cross section of the groove viewed in a direction along an axis of the rotation shaft has a V shape. As a result, a relative position between the needle and the looper can be positioned with significantly high accuracy.

8 Claims, 10 Drawing Sheets

(56) References Cited

U.S. PATENT DOCUMENTS

| | | | | | |
|---|---|---|---|---|---|
| RE33,382 | E | * | 10/1990 | Robinson | D05B 71/00<br>112/288 |
| 4,977,842 | A | * | 12/1990 | Fukao | D05B 57/06<br>112/165 |
| 5,383,414 | A | * | 1/1995 | Winter | D05B 61/00<br>112/162 |
| 5,732,639 | A | * | 3/1998 | Kojima | D05B 57/06<br>112/162 |
| 5,775,239 | A | * | 7/1998 | Papajewski | D05B 3/06<br>112/448 |
| 2004/0055521 | A1 | * | 3/2004 | Katou | D05B 11/00<br>112/260 |
| 2007/0272138 | A1 | * | 11/2007 | Johnston | D05C 15/22<br>112/80.01 |
| 2019/0360141 | A1 | | 11/2019 | Ikadai et al. | |
| 2020/0173079 | A1 | * | 6/2020 | James | D05B 65/00 |

FOREIGN PATENT DOCUMENTS

| | | | |
|---|---|---|---|
| CN | 103511481 | A | 1/2014 |
| CN | 208414806 | U | 1/2019 |
| DE | 10120239 | A1 | 10/2001 |
| JP | H07268762 | A | 10/1995 |
| JP | 6804563 | B2 | 12/2020 |
| SU | 1082884 | A1 | 3/1984 |
| WO | 2018135251 | A1 | 7/2018 |

* cited by examiner

SEWING DEVICE AND LOOPER POSITIONING METHOD

This application is based on and claims the benefit of priority from Chinese Patent Application No. 202110323474.X, filed on 26 Mar. 2021, the content of which is incorporated herein by reference.

BACKGROUND OF THE INVENTION

Field of the Invention

The present invention relates to a sewing device and a looper positioning method in the sewing device.

Related Art

A single chain stitch sewing device that forms stitches in a workpiece to be sewed using a needle and a looper has been known (see Patent Document 1). In the sewing device, the needle performs a reciprocating operation to penetrate the workpiece to be sewed from its one surface side to the other surface side and return to the one surface side again, while the looper performs a rotation operation on the other surface side of the workpiece to be sewed. A needle reciprocating operation for the needle having a thread passing hole provided on its needle tip side into which the thread has been inserted to repeatedly penetrate sequential sites with stepping of the workpiece to be sewed and return and a step-wise feeding operation of the workpiece to be sewed are synchronously repeated. The thread that has penetrated the workpiece to be sewed from the one surface side to the other surface side using the needle draws a predetermined loop while the looper rotates by skimming the thread with its claw. The thread that has penetrated the workpiece to be sewed then passes through the loop thus drawn, to draw a loop again. As a result, predefined stitches that are continuous because the loop has been entangled is formed on the other surface side of the workpiece to be sewed. A series of predefined stitches is formed on the one surface side of the workpiece to be sewed. There is a known method for fixing a looper with a set bolt (see Patent Document 2).

Patent Document 1: Japanese Patent No. 6804563

Patent Document 2: Japanese Unexamined Patent Application, Publication No. H07-268762

SUMMARY OF THE INVENTION

In the above-described sewing device, in order for the looper to reliably skim a sewing thread that has penetrated the workpiece to be sewed from the one surface side to the other surface side using the needle with the claw, a relative position between the needle and the looper is required to be maintained with significantly high accuracy. When the relative position between the needle and the looper is inappropriate, there occurs a so-called "stitch skip" meaning that the looper fails to skim the thread so that the loop is detangled, and stitches are partially discontinuous, which is very visually undesirable. The needle and the looper themselves are respectively consumables, and are required to be periodically replaced. However, reproducibility of the relative position between the needle and the looper is required with high accuracy at the time of the replacement. However, in a technique disclosed in Patent Document 1 entirely focused on provision of the single chain stitch sewing device capable of subjecting a narrow space to sewing, a problem of positioning relating to the relative position between the needle and the looper has not been recognized as an issue, and no solution has been presented. In the method for fixing a position of the looper with the set bolt disclosed in Patent Document 2, the looper cannot be positioned in an axial direction with respect to rotation thereof.

The present invention has been made in view of the above-described circumstances, and is directed to providing a sewing device capable of positioning, in a sewing device that forms stitches in a workpiece to be sewed using a needle and a looper, a relative position between the needle and the looper with significantly high accuracy.

(1) A sewing device (e.g., a sewing device 1, described below) including a needle (e.g., a needle 3, 3*a*, 3*b*, described below) and a looper (e.g., a looper 4, 4*a*, 4*b*, described below), the sewing device including a rotation shaft (e.g., a rotation shaft 27, described below) that rotates the looper, and a set bolt (e.g., a set bolt 36*a*, 36*b*, described below) that has a conical distal end and positions the looper in an axial direction relative to the rotation shaft from a radial direction of the rotation shaft, in which the looper includes a through screw hole (e.g., a through screw hole 35*a*, 35*b*, described below) into which the set bolt is screwed, the rotation shaft includes a groove (e.g., a groove 37*a*, 37*b*, described below) recessed from a peripheral surface of the rotation shaft, and the groove includes an inclined surface (e.g., 38*a*, 38*b*, described below) that the distal end of the set bolt contacts.

(2) The sewing device in the foregoing item (1), in which a cross section of the groove viewed in a direction along an axis of the rotation shaft has a V shape.

(3) The sewing device in the foregoing item (1) or (2), further including a mounting member (e.g., a mounting unit 45 including a support member 33, 33*a*, 33*b*, described below) that rotatably supports the rotation shaft to mount the looper, in which the distal end of the set bolt contacts the inclined surface so that the looper contacts a predetermined site of the mounting member (e.g., a corresponding site of the support member 33, 33*a*, 33*b*, described below).

(4) The sewing device in the foregoing item (3), in which the mounting member is fixed to a predetermined portion of the sewing device with a fixing bolt (e.g., a fixing bolt 47, described below), and an insertion hole (e.g., an insertion hole 50, described below) into which the fixing bolt is inserted is a long hole extending in the axial direction of the rotation shaft.

(5) The sewing device in the foregoing item (3) or (4), in which the rotation shaft includes a protrusion (e.g., a protrusion 39*a*, 39*b*, described below) protruding in the radial direction, and a recess (e.g., a recess 44, described below) corresponding to the protrusion is formed on a contact surface of the looper with the mounting member.

(6) A looper positioning method for positioning, in a sewing device including a needle that reciprocates and a looper that rotates by a rotation shaft, the looper relative to the rotation shaft, the looper positioning method including a set bolt mounting step (e.g., a set bolt mounting step S1, described below) of mounting a set bolt having a conical distal end on a through screw hole formed in the looper toward the rotation shaft from its outer peripheral side, and a position adjustment step (e.g., a position adjustment step S2, described below) of screwing the set bolt mounted on the through screw hole in the set bolt mounting step, adjusting a degree of screwing of the set bolt with the distal end contacting an inclined surface of a groove formed in the rotation shaft to be recessed from its peripheral surface, and adjusting a position of the looper relative to the rotation shaft.

(7) The looper positioning method in the foregoing item (6), in which in the position adjustment step, the set bolt is screwed until a boss in the looper contacts a predetermined contact surface of a mounting member that supports the rotation shaft.

(8) The looper positioning method in the foregoing item (7), further including an upper position adjustment step (e.g., an upper position adjustment step SS2, described below) of displacing both the mounting member and the rotation shaft relative to a predetermined installation portion of the sewing device to positionally adjust the mounting member and the rotation shaft.

In the sewing device described in the item (1), the looper can be positioned in the axial direction of the rotation shaft.

In the sewing device described in the item (2), the looper can be reliably positioned in the axial direction by the groove having a V-shaped cross section.

In the sewing device described in the item (3), the looper can be positioned to contact the mounting member.

In the sewing device described in the item (4), the looper positioned in and fixed to the mounting member, as included in the mounting member, is adjusted so that the looper can be positioned with higher accuracy.

In the sewing device described in the item (5), the looper can be positioned in the axial direction, and a phase of the looper with respect to the rotation position around the rotation shaft can be determined.

In the looper positioning method described in the item (6), the looper can be positioned in the axial direction of the rotation shaft.

In the looper positioning method described in the item (7), the looper can be positioned to contact the mounting member.

In the positioning method described in the item (8), the looper positioned in and fixed to the mounting member can be positioned with higher accuracy by adjusting the position of the looper, as included in the mounting member.

DETAILED DESCRIPTION OF THE INVENTION

Figure 1:
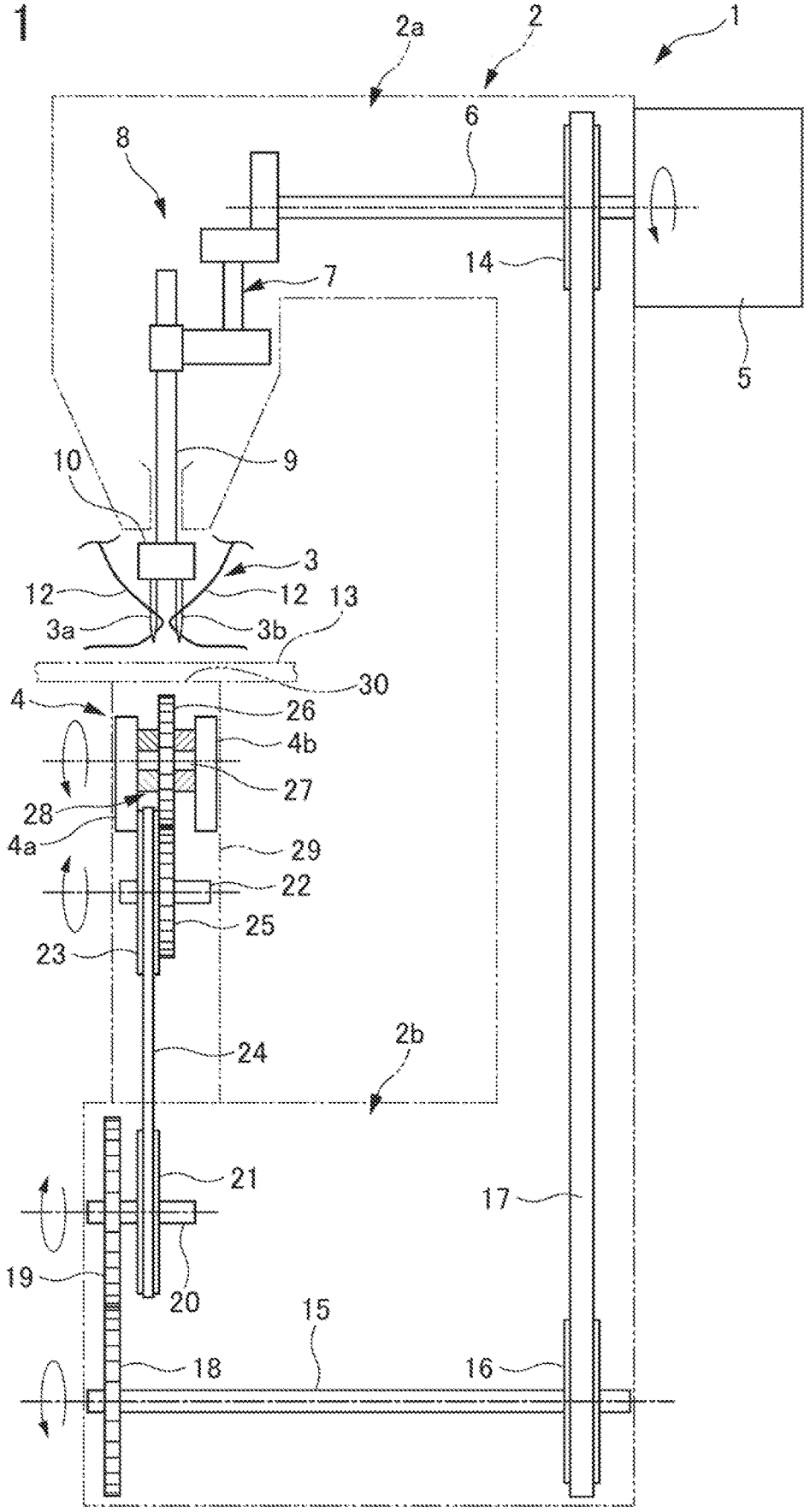
FIG. 1 is a schematic view illustrating a sewing device according to an embodiment of the present invention.

An embodiment of the present invention will be described below with reference to the drawings. FIG. 1 is a schematic view illustrating a sewing device 1 as the embodiment of the present invention. A sewing device main body 2 in the sewing device 1 is integrally configured with an arm portion 2*a* and a bed portion 2*b* being continuous in their respective connection portions. The arm portion 2*a* is provided with a motor 5 that supplies power for operation to a sewing needle 3 and a looper 4. Rotational motion of an upper shaft 6 connected to an axis of the motor 5 is transmitted to the needle 3 upon being converted into reciprocating motion by a motion conversion mechanism 8 including a crank mechanism 7. The needle 3 is attached to an end portion of a sliding rod 9 as a member for outputting the reciprocating motion in the motion conversion mechanism 8.

The needle 3 includes two needles 3*a* and 3*b* attached to a needle holder 10 in parallel in such a manner that their respective needle tips are oriented in the same direction, and the needle holder 10 is attached to the end portion of the sliding rod 9. Each of the two needles 3*a* and 3*b* forms stitches in a workpiece to be sewed 13 by similar reciprocating motion with a thread 12 inserted into its thread-passing hole 11. Each of the threads 12 respectively inserted into the needles 3*a* and 3*b* is supplied from a bobbin not illustrated. In the following description, the needles 3*a* and 3*b* are typically referred to as the needle 3, as needed.

The rotational motion of the upper shaft 6 is transmitted to a lower shaft 15 in the bed portion 2*b* by a first timing belt 17 stretched between a first pulley 14 provided in the upper shaft 6 and a second pulley 16 provided in the lower shaft 15. The rotational motion transmitted to the lower shaft 15 is transmitted to a relay shaft 20 by a relay gear 19 meshing with a lower shaft gear 18 provided in the lower shaft 15.

The rotational motion transmitted to the relay shaft 20 is transmitted to an intermediate shaft 22 by a second timing belt 24 stretched between a third pulley 21 provided in the relay shaft 20 and a fourth pulley 23 provided in the intermediate shaft 22.

The rotational motion transmitted to the intermediate shaft 22 is transmitted to a driven gear 26 meshing with an intermediate gear 25 provided in the intermediate shaft 22, and a rotation shaft 27 that rotates the looper 4 provided with the driven gear 26 rotates. As a result, the looper 4 rotates. The looper 4 is supported by a looper mounting mechanism 28, described below, and is protected thereby.

The looper 4 is provided in a post bed 29 having a substantially hollow prism shape protruding toward the needle tip of the needle 3 from the bed portion 2*b* in the sewing device main body 2. The post bed 29 is flat on its protrusion end side, to form a mount 30 on which the workpiece to be sewed 13 is mounted. The mount 30 is provided with an opening (not illustrated) through which the needles 3*a* and 3*b* can enter or leave a hollow interior of the post bed 29.

The looper 4 is configured such that two loopers 4*a* and 4*b* pivotably supported on a common rotation shaft 27 in the same rotation phase overlap each other in an axial direction with the driven gear 26 sandwiched therebetween. The rotation shaft 27 is provided at a position facing a rear surface of the mount 30 in the post bed 29. Accordingly, the loopers 4*a* and 4*b* are positioned to face the protrusion end side of the post bed 29 to respectively correspond to the two needles 3*a* and 3*b*. Both the two loopers 4*a* and 4*b* rotate around the common rotation shaft 27, and similarly function. In the following description, the two loopers 4*a* and 4*b* are typically referred to as the looper 4, as needed.

Figure 2:
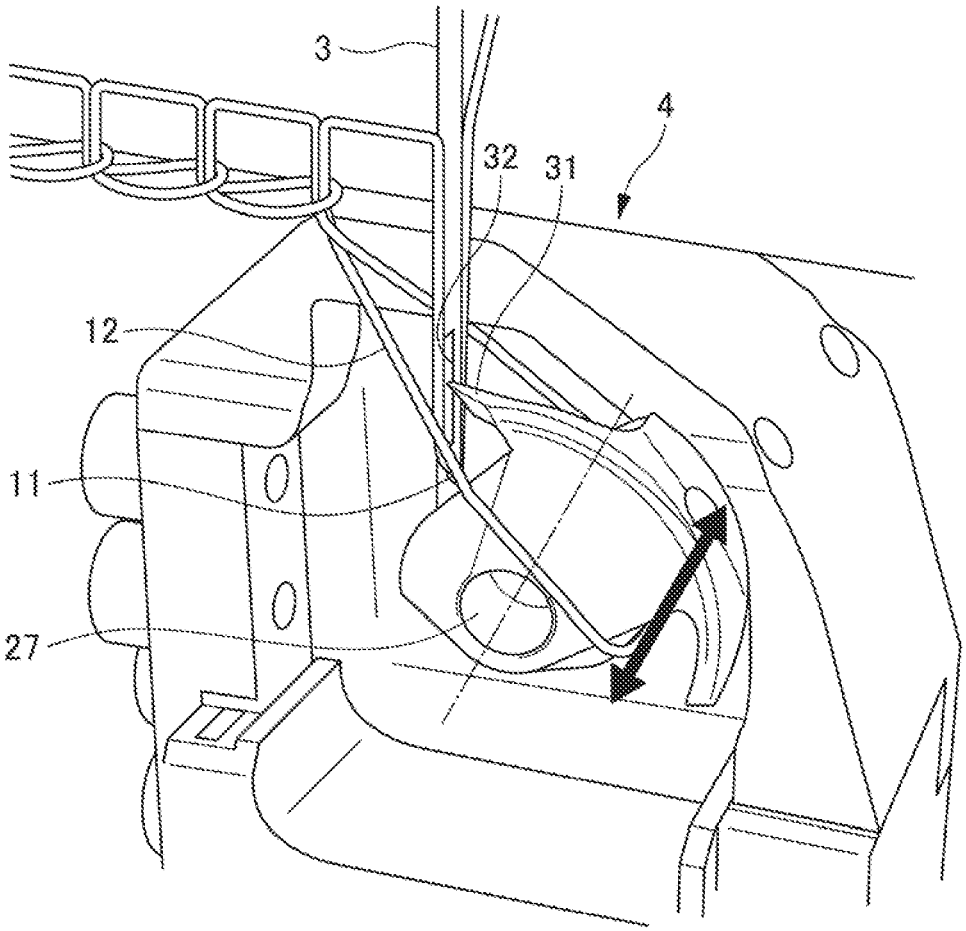
FIG. 2 is an enlarged perspective view illustrating the vicinity of a looper in the sewing device illustrated in FIG. 1, together with a needle and a thread.

FIG. 2 is an enlarged perspective view illustrating the vicinity of the looper 4 in the sewing device 1 illustrated in FIG. 1, together with the needle 3 and the thread 12. In FIG.

2, the workpiece to be sewed 13 between the needle 3 and the looper 4 is not illustrated. The looper 4 operates to rotate by the rotation shaft 27 on the other surface side of the workpiece to be sewed 13. The looper 4 has a circular arc-shaped outer peripheral portion with an axis of the rotation shaft 27 as its center of curvature, and constitutes a claw 31 that is sharp-pointed on its distal end side in a direction of the rotation. A needle reciprocating operation for the needle 3 by which the thread 12 is inserted into the thread-passing hole 11 provided on the needle tip side to repeatedly penetrate sequential sites with stepping of the workpiece to be sewed 13 and return and a step-wise feeding operation of the workpiece to be sewed 13 are synchronously repeated.

The thread 12 that has penetrated the workpiece to be sewed 13 from its one surface side to the other surface side (from its upper side to lower side in FIG. 2) using the needle 3 draws a loop as illustrated while the looper 4 rotates upon skimming the thread 12 by the claw 31. Through a loop of the thread 12 thus drawn, the thread 12 that has penetrated the workpiece to be sewed 13 then passes, to draw a loop again. As a result, predefined stitches that are continuous by entangling the loop of the thread 12 are formed on the other surface side (rear surface side) of the workpiece to be sewed 13. A series of predefined stitches is formed on the one surface side (front surface side) of the workpiece to be sewed 13.

Figure 3:
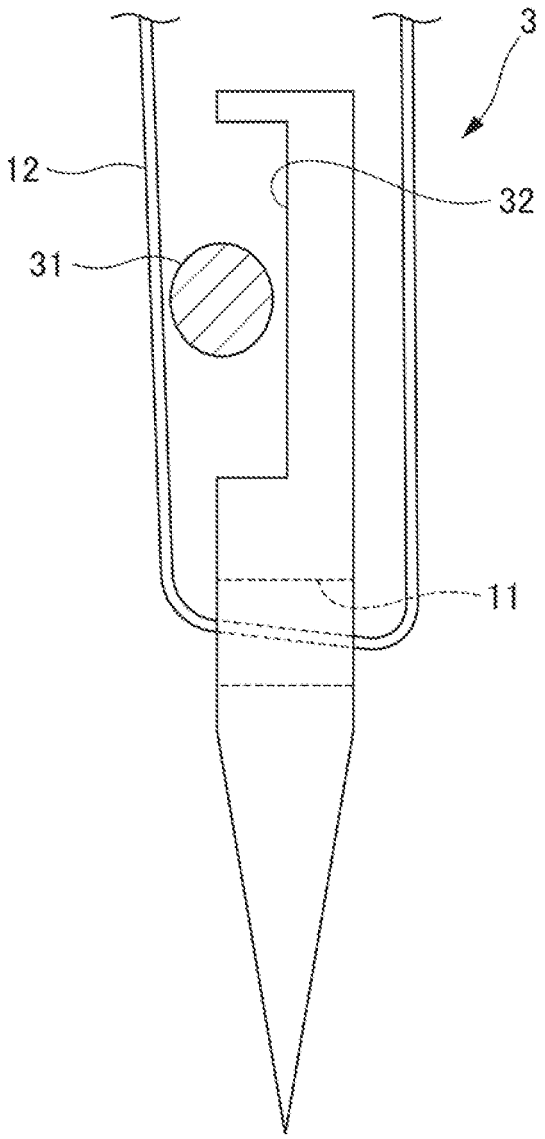
FIG. 3 is a diagram for describing a positional relationship between the looper and the needle illustrated in FIG. 2.

FIG. 3 is a diagram for describing a positional relationship between the looper 4 and the needle 3 illustrated in FIG. 2. A needle groove 32 recessed from a side peripheral surface of the needle 3 is formed over a short section in a longitudinal direction at a position slightly behind the thread-passing hole 11 at the needle tip in the vicinity of the thread-passing hole 11. The claw 31 in the looper 4 enters an area between the needle groove 32 in the needle 3 and the thread 12 when the needle 3 penetrates the workpiece to be sewed 13 while pulling the thread 12 inserted into the thread-passing hole 11 and its needle tip portion exits to the other surface side (rear surface side) of the workpiece to be sewed 13, to skim the thread 12 by rotation thereof (displacement thereof in a direction of penetration into the plane of paper of FIG. 3).

It is essential that every time the needle 3 repeatedly penetrates the workpiece to be sewed 13 by the reciprocating motion and the needle tip portion exits to the rear surface side of the workpiece to be sewed 13, the claw 31 in the looper 4 inevitably enters an area between the needle groove 32 and the thread 12 to reliably skim the thread 12. Accordingly, a position in the axial direction of the rotation shaft 27 in the looper 4 is required to be positioned such that the relationship illustrated in FIG. 3 is maintained with high accuracy. If a deviation occurs at the position in the axial direction of the rotation shaft 27 in the looper 4, a loop of the thread 12 drops without being entangled with a subsequent loop when continuous by being entangled therewith, thereby presenting a malfunction that a so-called "stitch skip" occurs.

Figure 4:
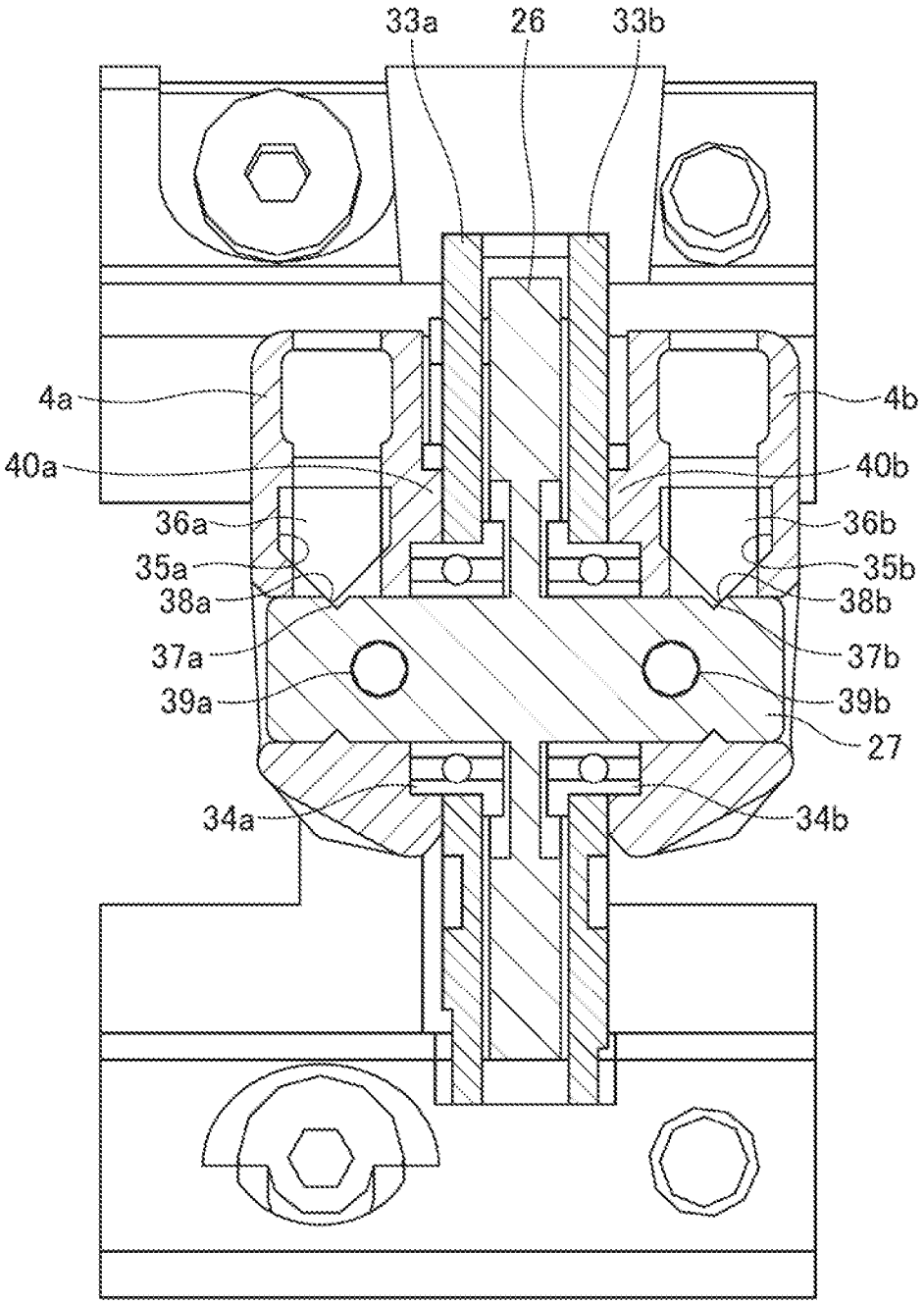
FIG. 4 is a partially sectional view of the looper illustrated in FIG. 1.

FIG. 4 is a partially sectional view of the looper 4 (4*a*, 4*b*) illustrated in FIG. 1. In FIG. 4, in a viewpoint of expecting the loopers 4*a* and 4*b* in a direction in which the needle 3 (3*a*, 3*b*) is directed toward the workpiece to be sewed 13, a cross section of the loopers 4*a* and 4*b* and a portion including a rotation shaft 27 that rotate the loopers 4*a* and 4*b* and a plate-shaped support member 33 that rotatably supports the rotation shaft 27 to mount the loopers 4*a* and 4*b*. The support member 33 is a critical member in a mounting unit 45, described below. In the support member 33, a support member 33*a* on the looper 4*a* side and a support member 33*b* on the looper 4*b* side are arranged in parallel with the driven gear 26 sandwiched therebetween. A clearance enough for the support members 33*a* and 33*b* and the driven gear 26 not to contact each other is provided therebetween. The rotation shaft 27 is pivotably supported by a pair of bearings 34*a* and 34*b* respectively provided in the support member 33*a* and the support member 33*b*.

Through screw holes 35*a* and 35*b* are respectively provided in a radial direction in the loopers 4*a* and 4*b*. Set bolts 36*a* and 36*b* each having a conical distal end and positioning the loopers 4*a* and 4*b* in the axial direction with respect to the rotation shaft 27 are respectively screwed into the through screw holes 35*a* and 35*b* from the radial direction of the rotation shaft 27.

The rotation shaft 27 has grooves 37*a* and 37*b* respectively recessed from its peripheral surface formed over the entire periphery thereof. The grooves 37*a* and 37*b* respectively have inclined surfaces 38*a* and 38*b* which their conical distal ends contact when the set bolts 36*a* and 36*b* are screwed thereinto. The rotation shaft 27 is provided with protrusions 39*a* and 39*b* protruding in the radial direction, respectively, at positions closer to the center in the axial direction than the grooves 37*a* and 37*b*.

Figure 5:
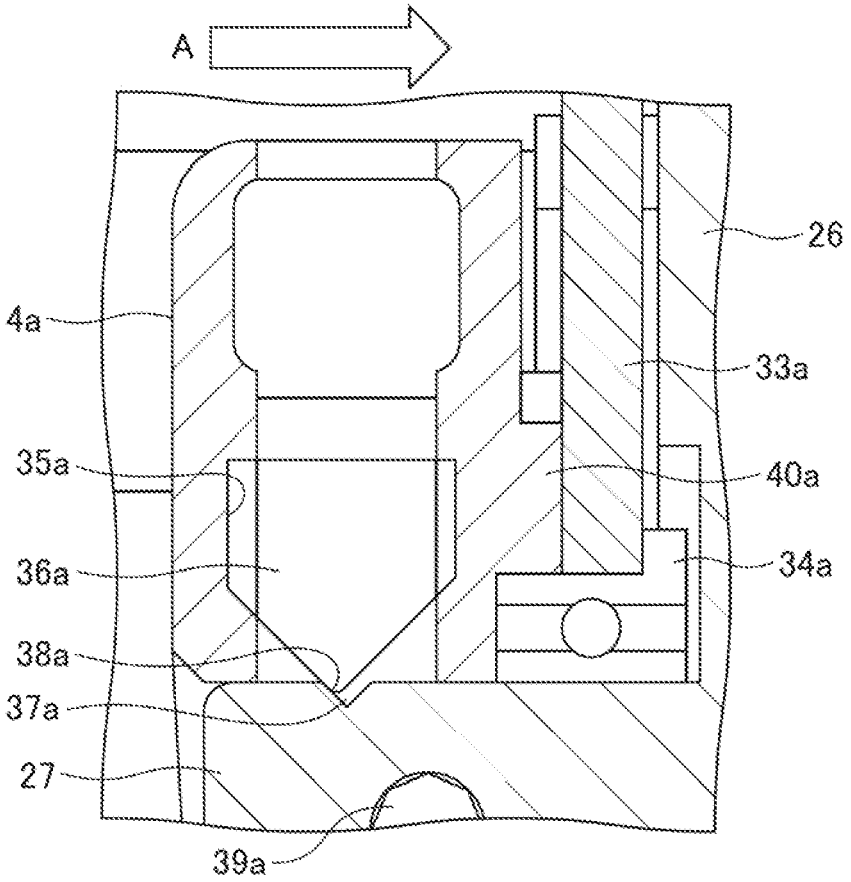
FIG. 5 is an enlarged view of a principal part illustrated in FIG. 4.

FIG. 5 is an enlarged view of a principal part illustrated in FIG. 4. As described with reference to FIG. 4, the rotation shaft 27 provided with the driven gear 26 is attached to the support member 33*a* by the bearing 34*a*. The looper 4*a* that rotates by the rotation shaft 27 is provided with the through screw hole 35*a*, and the set bolt 36*a* is screwed into the through screw hole 35*a*. The groove 37*a* is formed in the rotation shaft 27. A cross section viewed in a direction along an axis of the groove 37*a* has a V shape so that the groove 37*a* has the inclined surface 38*a*.

On the other hand, a boss 40*a* protruding toward the support member 33*a* is formed in a site in the vicinity of the outer periphery of the bearing 34*a* in the looper 4*a*. A similar boss 40*b* to the boss 40*a* formed in the looper 4*a* is also formed in the looper 4*b* described with reference to FIG. 4. The boss 40*a* slidably contacts the support member 33*a*. The set bolt 36*a* is screwed into the through screw hole 35*a* in the looper 4*a*, to bring its conical distal end site into contact with the inclined surface 38*a* of the groove 37*a*. When the set bolt 36*a* further protrudes toward a deep portion of the groove 37*a*, the distal end side of the set bolt 36*a* is guided to the inclined surface 38*a* of the groove 37*a*, and as a result the entire looper 4*a* is displaced toward the support member 33*a*, as indicated by an arrow A. The displacement causes the boss 40*a* to contact a corresponding portion of the support member 33*a* so that the looper 4*a* is positioned in the axial direction.

Figure 6:
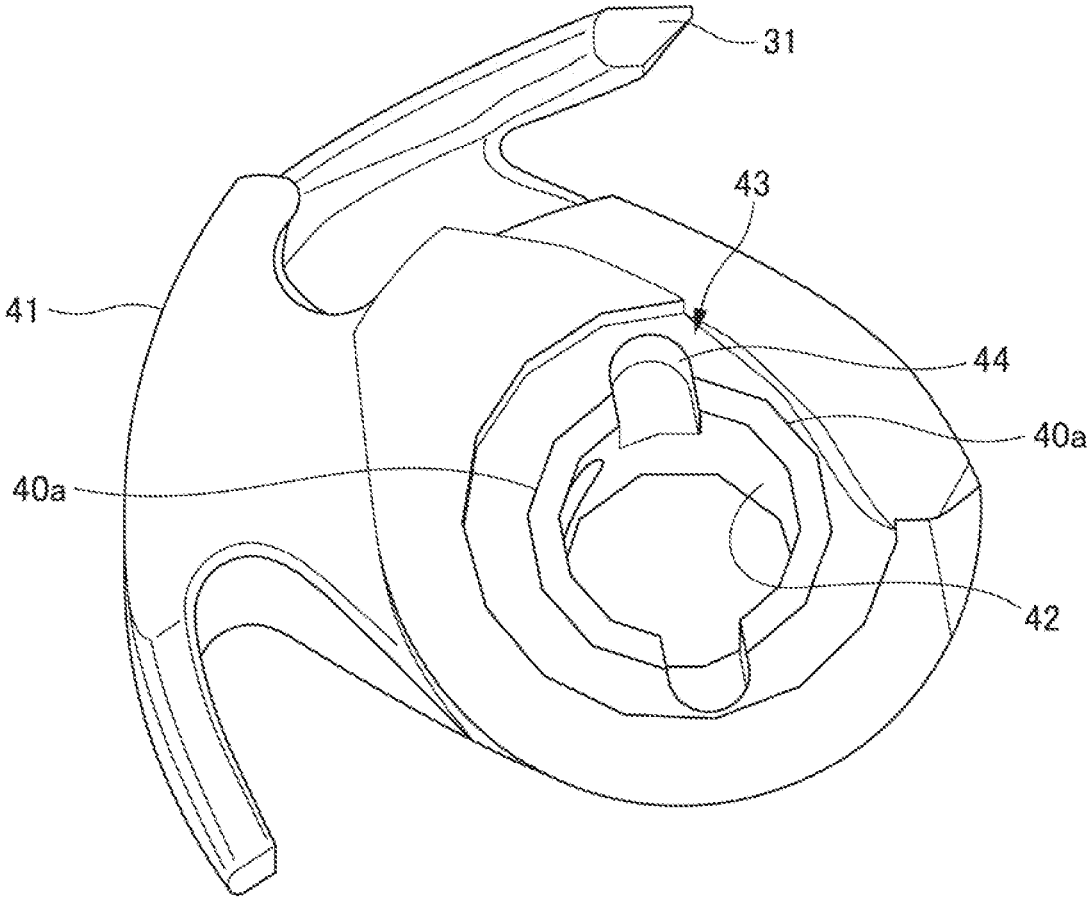
FIG. 6 is an enlarged perspective view of the looper illustrated in FIG. 1.

FIG. 6 is an enlarged perspective view of the looper 4 illustrated in FIG. 1. Although the one looper 4*a* is typically described as the looper 4 in FIG. 6, the other looper 4*b* in FIG. 1 has a shape plane-symmetrical with the looper 4*a*. In FIG. 6, the looper 4*a* is viewed from the side facing the support member 33*a* in FIG. 4.

The looper 4*a* includes an arc-shaped portion 41 as a circular arc-shaped outer peripheral portion with an axis of the rotation shaft 27 as its center of curvature, and a distal end side in a direction of rotation of the arc-shaped portion 41 constitutes a sharp-pointed claw 31. A central portion of the looper 4*a* is provided with an opening 42 corresponding to an outer shape of the rotation shaft 27. A boss 40*a* is formed around the opening 42. The vicinity of the opening 42 in the looper 4*a* is a contact surface 43 with the support member 33*a*.

A recess 44 communicating with an inner peripheral surface of the opening 42 is formed in the contact surface 43. The recess 44 has a shape and a dimension corresponding to the protrusion 39*a* in the rotation shaft 27. The protrusion 39*a* is fitted in the recess 44 with the looper 4*a* positioned in the axial direction by contact between the set bolt 36*a* and the inclined surface 38*a* of the groove described with reference to FIG. 4 and FIG. 5. As a result, the looper 4*a* is maintained with its phase in the direction of the rotation confirmed.

Figure 7:
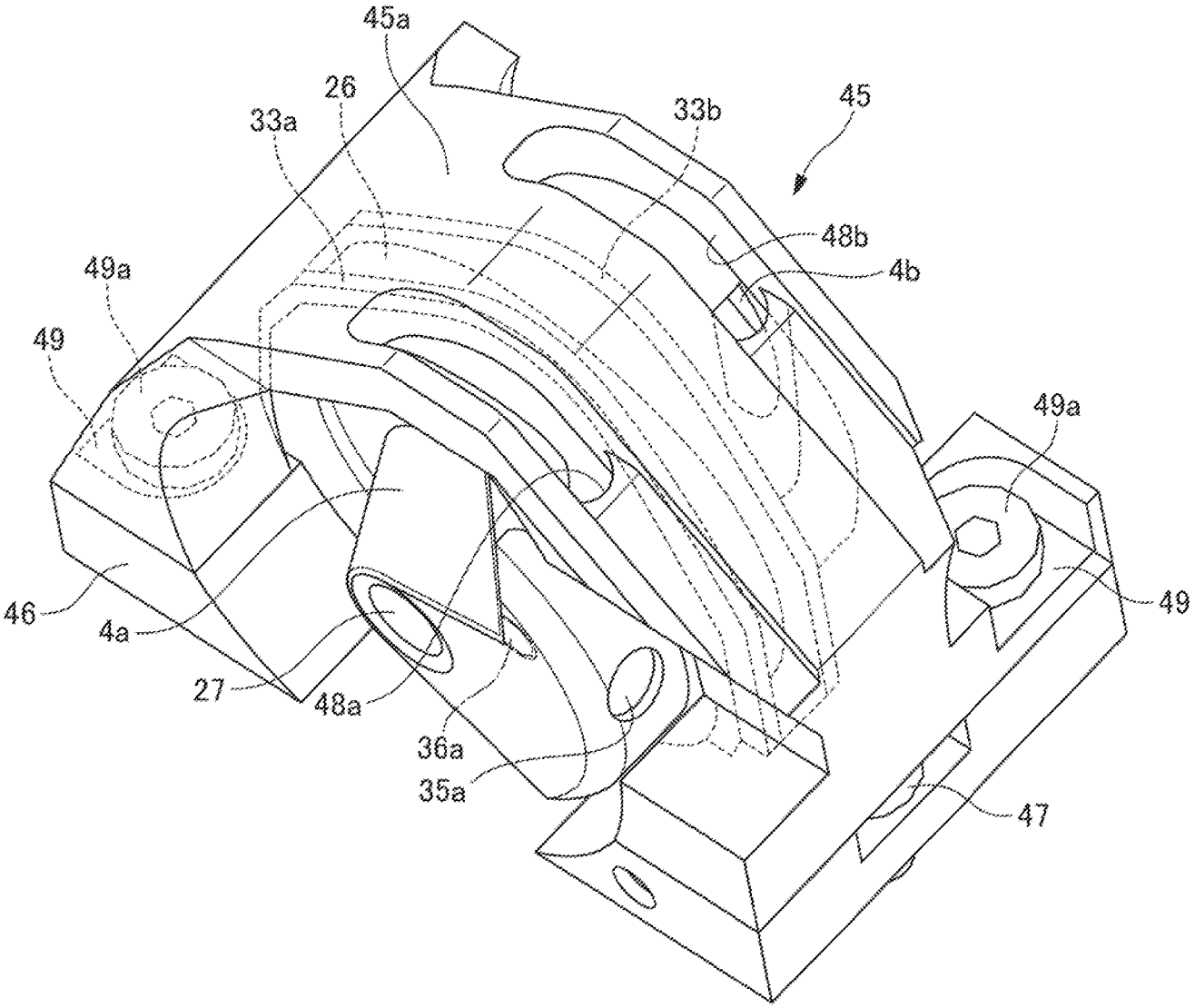
FIG. 7 is a perspective view of a mounting unit including a mounting member that mounts the looper illustrated in FIG. 2.

FIG. 7 is a perspective view of the mounting unit 45 as a mounting member that mounts the looper 4 illustrated in FIG. 2. The mounting unit 45 includes a support member 33 that rotatably supports the rotation shaft 27. In FIG. 7, portions corresponding to those already described in FIG. 4 and FIG. 5 are respectively assigned the same reference numerals, and description in FIG. 4 and FIG. 5 is referred to as appropriate for the corresponding portions. The plate-shaped support members 33*a* and 33*b* are each a critical portion of the mounting unit 45 that supports the rotation shaft 27 in the looper 4. The mounting unit 45 includes a base portion 46 to be a base. The two support members 33*a* and 33*b* are fitted in and fixed to a groove not illustrated formed in the base portion 46 on their respective base sides, and are raised in parallel. The mounting unit 45 includes a cover 45*a* that protects the looper 4 that rotates. The mounting unit 45 is positioned in and fixed to a flat structure 28*a* (FIG. 9) at a top of the looper mounting mechanism 28 arranged in the post bed 29 in the sewing device 1 illustrated in FIG. 1.

In the looper mounting mechanism 28 illustrated in FIG. 1, the flat structure 28*a* is positioned at a position that more retreats from the mount 30 in the post bed 29 in the sewing device 1 than an outer dimension of the looper 4 (above an intermediate position of the post bed 29 in the figure). The mounting unit 45 is fixed to the flat structure 28*a* (FIG. 9) with a fixing bolt 47. A cover 45*a* in the mounting unit 45 is provided with a needle advance/retreat opening 48 (48*a*, 48*b*) for permitting an advance/retreat operation of the needle 3 (3*a*, 3*b*) to/from the inside of the mounting unit 45.

As described with reference to FIG. 2 and FIG. 3, a relative position in the axial direction of the rotation shaft 27 between the looper 4 (4*a*, 4*b*) and the needle 3 (3*a*, 3*b*) is required to be positioned with high accuracy. When the mounting unit 45 is fixed to the flat structure 28*a* (FIG. 9) with the fixing bolt 47, the relative position between the looper 4 (4*a*, 4*b*) and the needle (3*a*, 3*b*) can also be adjusted by adjusting a relative position in the axial direction between the mounting unit 45 and the flat structure 28*a*. A mount portion of the cover 45*a* to the base portion 46 constitutes a plate member to be mounted 49. The cover 45*a* is mounted to base portion 46 with a mounting bolt 49*a* in the plate member to be mounted 49.

Figure 8:
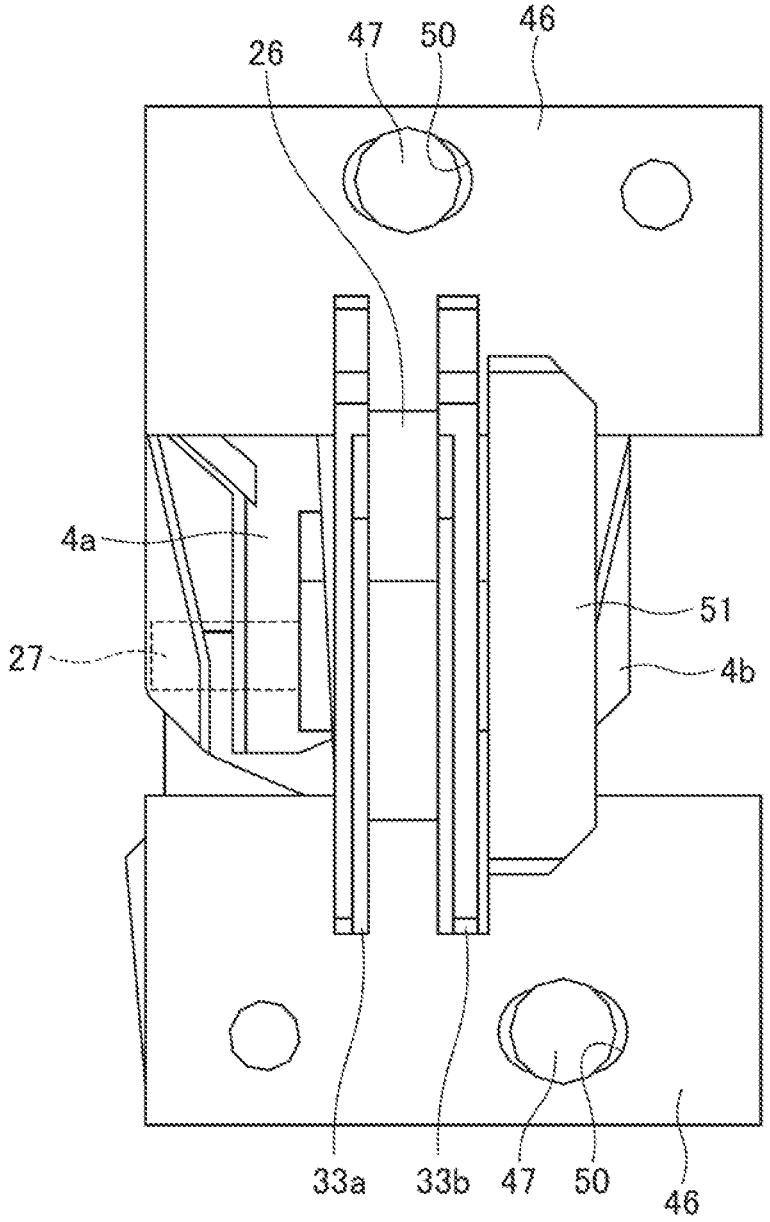
FIG. 8 is a conceptual diagram for describing a mechanism for positioning the mounting unit illustrated in FIG. 7.

FIG. 8 is a conceptual diagram for describing a mechanism for positioning the mounting unit illustrated in FIG. 7. In FIG. 8, portions corresponding to those illustrated in FIG. 4, FIG. 5, and FIG. 7 are respectively assigned the same reference numerals, and description already described is referred to as appropriate for description of the corresponding portions. In FIG. 8, a configuration around the support members 33*a* and 33*b* is illustrated by omitting a large part of the mounting unit 45 including the cover 45*a*. The base portion 46 communicating with the support members 33*a* and 33*b* is provided with an insertion hole 50 in the fixing bolt 47. The insertion hole 50 is a long hole extending in the axial direction of the rotation shaft 27. Accordingly, the mounting unit 45 (FIG. 7) including the support members 33*a* and 33*b* can be positionally adjusted in the axial direction of the rotation shaft 27 within a range regulated by the insertion hole 50 for the flat structure 28*a* (FIG. 9) with the fixing bolt 47 loosened.

In this example, a support block for positioning 51 a predefined positional relationship with the base portion 46 of which is maintained is prepared. When the base portion 46 is fixed to the flat structure 28*a* (FIG. 9) with the fixing bolt 47 with an outer surface (a surface on the looper 4*b* side) of the support member 33*b* brought into contact with the support block for positioning 51, the rotation shaft 27 in the looper 4 (4*a*, 4*b*), as included in the mounting unit 45 (FIG. 7) including the support members 33*a* and 33*b* is positioned and fixed in the axial direction.

Figure 9:
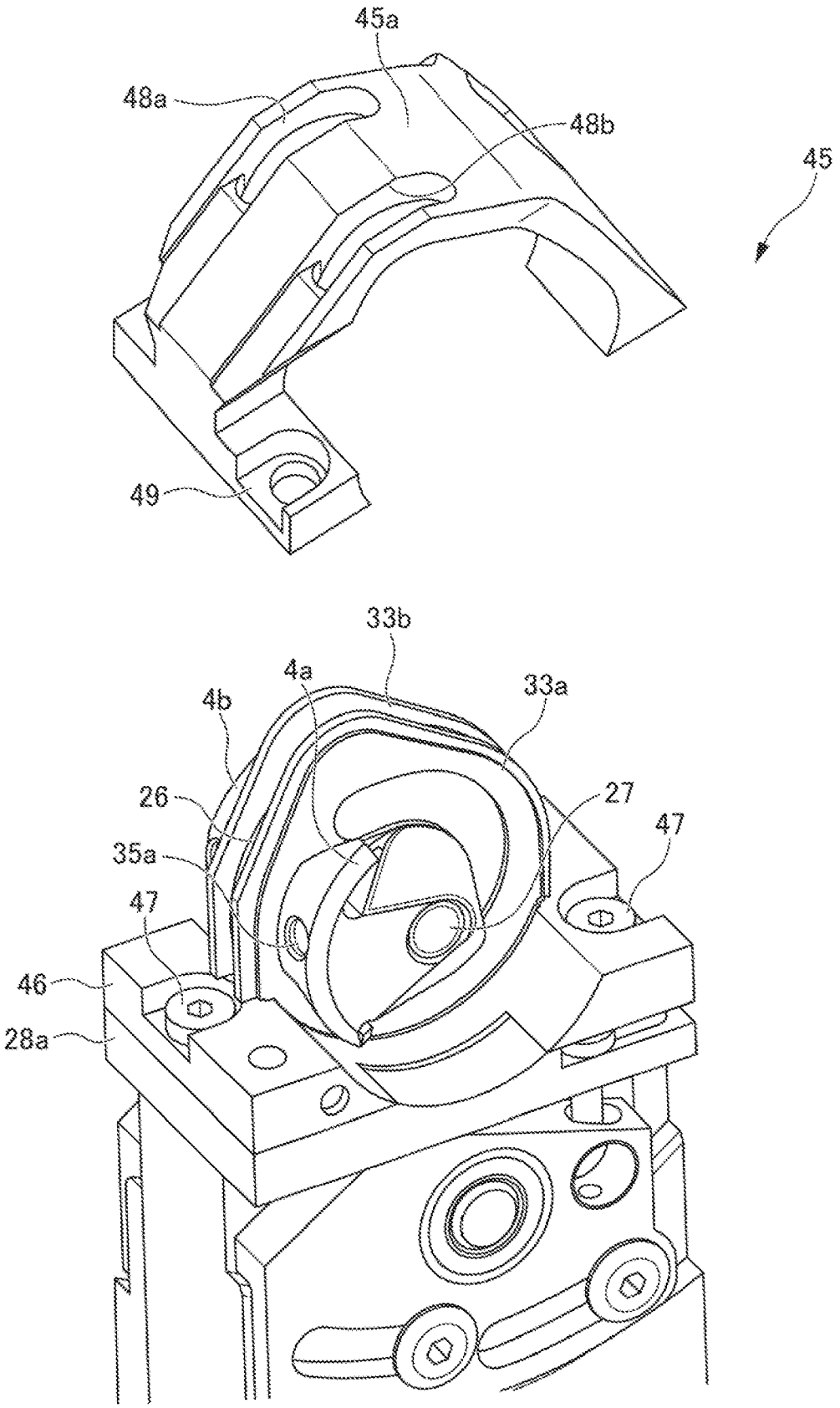
FIG. 9 is an exploded perspective view illustrating the mounting unit illustrated in FIG. 7 with a cover opened.

FIG. 9 is an exploded perspective view illustrating the mounting unit illustrated in FIG. 7 with a cover opened. In FIG. 9, portions corresponding to those illustrated in FIG. 4, FIG. 5, FIG. 7, and FIG. 8 are respectively assigned the same reference numerals, and description already described is referred to as appropriate for description of the corresponding portions. A method for positioning a looper as the embodiment of the present invention will be described with reference to FIG. 4, FIG. 5, FIG. 7, FIG. 8, and FIG. 9.

First, the set bolts 36*a* and 36*b* are respectively mounted on the through screw holes 35*a* and 35*b* in the loopers 4*a* and 4*b* (a set bolt mounting step S1).

Then, when the set bolts 36*a* and 36*b* are screwed, the respective conical distal end sites are brought into contact with the inclined surfaces 38*a* and 38*b* of the grooves 37*a* and 37*b* in the rotation shaft 27. Accordingly, the loopers 4*a* and 4*b* respectively move to come closer to the support members 33*a* and 33*b* in the axial direction of the rotation shaft 27. A degree of screwing of the set bolts 36*a* and 36*b* is adjusted, to move the loopers 4*a* and 4*b* until the bosses 40*a* and 40*b* (FIG. 6) respectively contact (slidably contact) the support members 33*a* and 33*b*. As a result, the loopers 4*a* and 4*b* are respectively positioned in the axial direction of the rotation shaft 27 (a position adjustment step S2).

In this state, the insertion hole 50 as a long hole is further utilized, to move the base portion 46 relative to the flat structure 28*a* (FIG. 9) and position and fix the loopers 4*a* and 4*b*, as included in the mounting unit 45 (an upper position adjustment step SS2).

Figure 10:
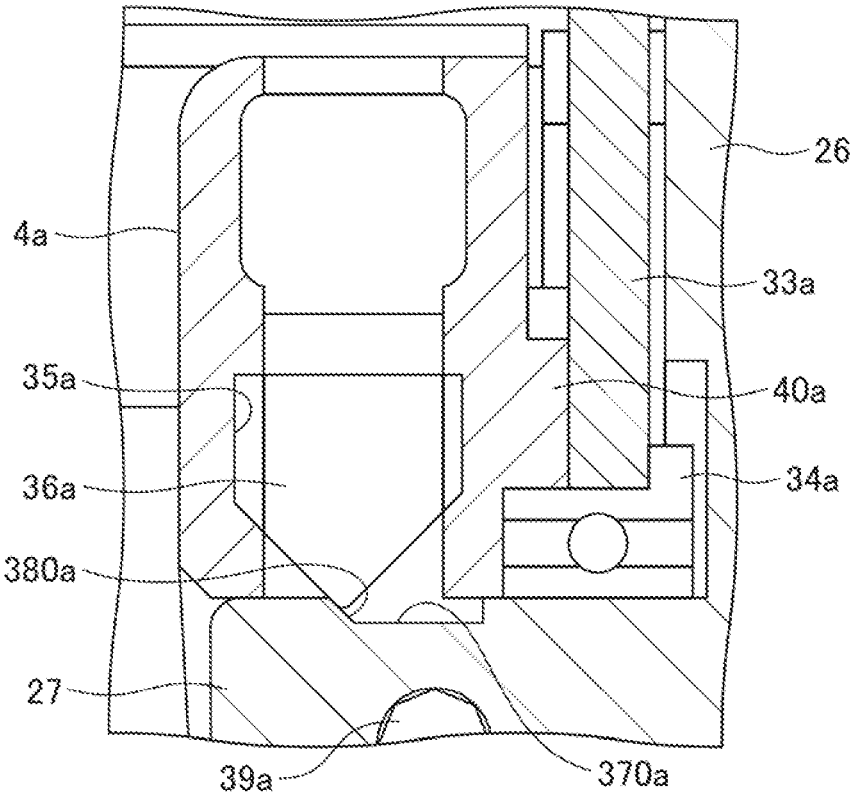
FIG. 10 is an enlarged view of a principal part illustrating another example of the sewing device illustrated in FIG. 1.

FIG. 10 is an enlarged view of a principal part illustrating another example of the sewing device 1 illustrated in FIG. 1. In FIG. 10, portions corresponding to those illustrated in FIG. 5 are respectively assigned the same reference numerals, and a difference from FIG. 5 will be described. Although the groove 37*a* is a V-shaped groove in the embodiment illustrated in FIG. 5, a groove 370*a* in this example has a bottom portion being wider in the axial direction. An inclined surface 380*a* farther from the center of a rotation shaft 27 on a wall surface of the groove 370*a* formed in the rotation shaft 27 contacts a conical distal end site of a set bolt 36*a* to effectively function to displace the set bolt 36*a* toward the center of the rotation shaft 27 and position the set bolt 36*a*.

The sewing device and the looper positioning method according to the present embodiment have the following effects.

In the sewing device 1 described in the item (1), the set bolts 36*a* and 36*b* are respectively screwed into the through screw holes 35*a* and 35*b* in the loopers 4*a* and 4*b*, and the conical distal ends of the set bolts 36*a* and 36*b* are respectively made to protrude toward the grooves 37*a* and 37*b* recessed from the peripheral surface in the radial direction of the rotation shaft 27 and brought into contact with the inclined surfaces 38*a* and 38*b* of the grooves 37*a* and 37*b* so that the loopers 4*a* and 4*b* can be positioned in the axial direction.

In the sewing device 1 described in the item (2), the cross section of the grooves 37*a* and 37*b* viewed in the direction along the axis of the rotation shaft 27 has a V shape. Accordingly, the loopers 4*a* and 4*b* can be reliably positioned in the axial direction.

The sewing device 1 described in the item (3) includes the mounting unit 45 including the support members 33*a* and 33*b* that rotatably support the rotation shaft 27 to respectively mount the loopers 4*a* and 4*b*, and the loopers 4*a* and 4*b* respectively contact corresponding sites of the support members 33*a* and 33*b* as the predetermined sites of the mounting unit 45 when the distal ends of the set bolts 36*a* and 36*b* contact the inclined surfaces 38*a* and 38*b* of the grooves 37*a* and 37*b*. Accordingly, the loopers 4*a* and 4*b* can be positioned to respectively contact the predetermined sites of the mounting unit 45.

In the sewing device 1 described in the item (4), the mounting unit 45 including the support members 33*a* and 33*b* is fixed to the predetermined portion of the sewing device 1 with the fixing bolt 47, and the insertion hole 50 into which the fixing bolt 47 is inserted is a long hole extending in the axial direction of the rotation shaft 27. Accordingly, the loopers 4*a* and 4*b* mounted to the mounting unit 45, respectively, by the support members 33*a* and 33*b* can be positioned with higher accuracy by adjusting positions of the loopers 4*a* and 4*b*, as included in the mounting unit 45.

In the sewing device 1 described in the item (5), the rotation shaft 27 includes the protrusions 39*a* and 39*b* protruding in the radial direction, and the recesses 44 corresponding to the protrusions 39*a* and 39*b* are respectively formed on the contact surfaces of the loopers 4*a* and 4*b* with the support members 33*a* and 33*b*. Accordingly, the loopers 4*a* and 4*b* are positioned in the axial direction, and the respective phases of the loopers 4*a* and 4*b* with respect to the rotation positions around the rotation shaft 27 can be determined.

In the looper positioning method described in the item (6), in the set bolt mounting step S1, the set bolts 36*a* and 36*b* each having the conical distal end are respectively mounted on the through screw holes formed in the loopers 4*a* and 4*b* from the outer peripheral sides thereof toward the rotation shaft 27. Then, in the position adjustment step S2, with the distal ends of the set bolts 36*a* and 36*b* respectively brought into contact with the inclined surfaces 38*a* and 38*b* of the grooves 37*a* and 37*b* formed in the rotation shaft 27 to be recessed from the peripheral surface thereof, the degree of screwing of the set bolts 36*a* and 36*b* is adjusted, to adjust the respective positions of the loopers 4*a* and 4*b* relative to the rotation shaft 27. As a result, the loopers 4*a* and 4*b* can be positioned in the axial direction of the rotation shaft 27.

In the looper positioning method described in the item (7), in the position adjustment step, the set bolts 36*a* and 36*b* are screwed until the bosses 40*a* and 40*b* in the loopers 4*a* and 4*b* respectively contact the predetermined contact surfaces of the support members 33*a* and 33*b* in the mounting unit 45 that supports the rotation shaft 27. As a result, the loopers 4*a* and 4*b* can be respectively positioned to contact corresponding sites of the support members 33*a* and 33*b* as predetermined sites of the mounting unit 45.

The looper positioning method described in the item (8) includes the upper position adjustment step SS2 of displacing both the support members 33*a* and 33*b* and the rotation shaft 27 relative to the predetermined installation portion of the sewing device 1 to positionally adjust the support members 33*a* and 33*b* and the rotation shaft 27. As a result, the loopers 4*a* and 4*b* respectively positioned in and fixed to the support members 33*a* and 33*b* can be positioned with high accuracy by adjusting the respective positions of the loopers 4*a* and 4*b*, as included in the support members 33*a* and 33*b*.

Although the embodiment of the present invention has been described above, the present invention is not limited to this. A configuration of details may be appropriately changed within the spirit of the present invention. For example, although the loopers 4*a* and 4*b* are positioned in the axial direction of the rotation shaft 27 in the above-described embodiment, the looper mounting mechanism 28 in the sewing device 1 may be configured to include a multilayer base portion so that positions of the loopers 4*a* and 4*b* can be respectively adjusted in the axial direction, as included in the support members 33*a* and 33*b*, like in the above-described embodiment, in a base portion on the first layer, while positions of the loopers 4*a* and 4*b* can be respectively adjusted in a direction intersecting the rotation shaft 27, as included in the support members 33*a* and 33*b* in a base portion on the second layer.

EXPLANATION OF REFERENCE NUMERALS

1 Sewing device
2 Sewing device main body
2*a* Arm portion
2*b* Bed portion
3, 3*a*, 3*b* Needle
4, 4*a*, 4*b* Looper
5 Motor
6 Upper shaft
7 Crank mechanism
8 Motion conversion mechanism
9 Sliding rod
10 Needle holder
11 Thread-passing hole
12 Thread
13 Workpiece to be sewed
14 First pulley
15 Lower shaft
16 Second pulley
17 First timing belt
18 Lower shaft gear
19 Relay gear
20 Relay shaft
21 Third pulley
22 Intermediate shaft
23 Fourth pulley
24 Second timing belt
25 Intermediate gear
26 Driven gear
27 Rotation shaft
28 Looper mounting mechanism
28*a* Flat structure
29 Post bed
30 Mount
31 Claw
32 Needle groove
33, 33*a*, 33*b* Support member
34*a*, 34*b* Bearing
35*a*, 35*b* Through screw hole
36*a*, 36*b* Set bolt
37*a*, 38*b*, 370*a* Groove
38*a*, 38*b*, 380*a* Inclined surface

39*a*, 39*b* Protrusion
40*a*, 40*b* Boss
41 Arc-shaped portion
42 Opening
43 Contact surface
44 Recess
45 Mounting unit (mounting member)
45*a* Cover
46 Base portion
47 Fixing bolt
48 (48*a*, 48*b*) Needle advance/retreat opening
49 Plate member to be mounted
49*a* Mounting bolt
50 Insertion hole
51 Support block for positioning

What is claimed is:

1. A sewing device comprising a needle and a looper, the sewing device comprising:

a rotation shaft that rotates the looper: and a set bolt that has a conical distal end and positions the looper in an axial direction relative to the rotation shaft from a radial direction of the rotation shaft, wherein the looper includes a through screw hole into which the set bolt is screwed, the rotation shaft includes a groove recessed from a peripheral surface of the rotation shaft, and the groove includes an inclined surface that the conical distal end of the set bolt contacts.

2. The sewing device according to claim 1, wherein a cross section of the groove viewed in a direction along an axis of the rotation shaft has a V shape.

3. The sewing device according to claim 1, further comprising:

a mounting member that rotatably supports the rotation shaft to mount the looper, wherein the conical distal end of the set bolt contacts the inclined surface so that the looper contacts a predetermined site of the mounting member.

4. The sewing device according to claim 1, further comprising:

a mounting member that rotatably supports the rotation shaft to mount the looper, wherein the conical distal end of the set bolt contacts the inclined surface so that he looper contacts a predetermined site of the mounting member, the mounting member is fixed to a predetermined portion of the sewing device with a fixing bolt, and an insertion hole into which the fixing bolt is inserted is a slotted hole extending in the axial direction of the rotation shaft.

5. The sewing device according to claim 1, further comprising:

a mounting member that rotatably supports the rotation shaft to mount the looper, wherein the conical distal end of the set bolt contacts the inclined surface so that the looper contacts a predetermined site of the mounting member, the rotation shaft includes a protrusion protruding in the radial direction defined by the shaft, and a recess corresponding to the protrusion is formed on a contact surface of the looper with the mounting member.

6. A looper positioning method for positioning, in a sewing device comprising a needle that reciprocates and a looper that rotates by a rotation shaft, the looper relative to the rotation shaft, the looper positioning method comprising:

a set bolt mounting step of mounting a set bolt having a conical distal end on a through screw hole formed in the looper toward the rotation shaft from its outer peripheral side; and a position adjustment step of screwing the set bolt mounted on the through screw hole in the set bolt mounting step, adjusting a degree of screwing of the set bolt with the conical distal end contacting an inclined surface of a groove formed in the rotation shaft to be recessed from its peripheral surface, and adjusting a position of the looper relative to the rotation shaft.

7. The looper positioning method according to claim 6, wherein in the position adjustment step; the set bolt is screwed until a boss in the looper contacts a predetermined contact surface of a mounting member that supports the rotation shaft.

8. The looper positioning method according to claim 6, wherein in the position adjustment step, the set bolt is screwed until a boss in the looper contacts a predetermined contact surface of a mounting member that supports tile rotation shaft, further comprising an upper position adjustment step of displacing both the mounting member and the rotation shaft relative to a predetermined installation portion of the sewing device to positionally adjust the mounting member and the rotation shaft.

* * * * *